US005601111A

United States Patent [19]

Sodergard

[11] Patent Number: 5,601,111

[45] Date of Patent: Feb. 11, 1997

[54] METHOD FOR AUTOMATICALLY CIRCULATING AND THEN HALTING CIRCULATION OF WASTEWATER IN A WASTEWATER PUMP STATION, AND A VALVING DEVICE THEREFORE

[75] Inventor: Bengt Sodergard, Upplands Vasvby, Sweden

[73] Assignee: ITT Flygt AB, Solna, Sweden

[21] Appl. No.: 502,876

[22] Filed: Jul. 17, 1995

Related U.S. Application Data

[63] Continuation of Ser. No. 229,969, Apr. 19, 1994, abandoned.

[51] Int. Cl.[6] ..... F04B 1/00

[52] U.S. Cl. ..... 137/498; 251/57; 417/299

[58] Field of Search ..... 417/299; 137/498, 137/500, 519.5, 115, 117; 251/57

[56] References Cited

U.S. PATENT DOCUMENTS

| | | | |
|---|---|---|---|
| 2,475,585 | 7/1949 | Baird | 137/498 |
| 3,870,436 | 3/1975 | Remy | 417/299 |
| 4,925,375 | 5/1990 | Carlsson | 417/299 X |
| 5,161,958 | 11/1992 | Landquist | 417/299 |

*Primary Examiner*—John Rivell
*Attorney, Agent, or Firm*—Menotti J. Lombardi

[57] ABSTRACT

A valve housing has a chamber formed therewithin, and an inlet and an outlet for accommodating fluid flow through the chamber along a given flow path. The housing further confines a free ball therein, and hydraulic-fluid filed compartments with flexible walls. Intermediate the inlet and outlet, the housing has a valve seat formed. Fluid pressure in the chamber causes one compartment to collapse and the flexible wall of the other to expand. The expanding wall, and capturing fluid flow, moves the ball to the seat to halt flow through the chamber, after an initial period of free flow. The method comprises providing the chambered housing, disposing the ball in the chamber, communicating the inlet with a pump outlet, and confining the flexible-walled compartments in the chamber.

5 Claims, 2 Drawing Sheets

METHOD FOR AUTOMATICALLY CIRCULATING AND THEN HALTING CIRCULATION OF WASTEWATER IN A WASTEWATER PUMP STATION, AND A VALVING DEVICE THEREFORE

This application is a continuation of application Ser. No. 08/229,969, filed Apr. 19, 1994, now abandoned.

BACKGROUND OF THE INVENTION

This invention pertains to waste water pump stations, such as are used in municipal sewage systems, and in particular to a method for automatically causing a circulation of waste water within the station, coincident with pump start-up and, subsequently, automatically halting the circulation, as well as to a novel valving device for use with the method.

As is described in the Swedish Patent Application 7908743-3, sludge banks occur in waste water pump stations, and other such tanks, in sewage systems, because the waste water circulation is poor. Sludge banks cause troublesome problems, such as bad odors, a risk of explosion, corrosion, and the like. According to the cited patent application, the noted problems are solved by arranging a valve in communication with the pump outlet, the valve opening temporarily to cause waste water circulation within the station, and flushing thereof. By this means, the sludge banks are dissolved and the fluid in the station is well homogenized.

The aforesaid valve is controlled, electrically, with a linear motor which displaces a slide in the valve. There is a disadvantage to this arrangement, in addition to the relatively high cost thereof. The slide can easily become clogged, as the pumped medium in the station normally contains considerable solid bodies such as stones, rags, and similar objects. If the valve slide becomes stuck, by a stone or other, it fails to function, and the motor can break down. Too, in that the motor is electrically powered, there are installations where it is unacceptable as explosive gases are present.

In Swedish Patent No. 8900597-9 there is disclosed an arrangement in which only pump pressure is used to control the valve. Therein, pressure created by the waste water flow moves a flapper element into a closed position after a given period of time. This arrangement has the disadvantage, however, that all too often the fluid pressure is too weak to be able to move the element to a closed position.

It is an object of this invention to set forth a method for automatically circulating, and then halting circulation of waste water in a waste water pump station, and to disclose a novel valving device for use with the method, which are simple and reliable, independent of the pressure level in the station.

SUMMARY OF THE INVENTION

Particularly, it is an object of this invention to disclose, for use in a station having a waste water pump, a method for, first, automatically circulating waste water within the station upon pump start-up, and, second, automatically halting waste water circulation therewithin, subsequently, comprising the steps of providing a housing having (a) a chamber formed therewithin, (b) an inlet, and (c) an outlet for conducting waste water through said chamber between said inlet and said outlet along a given flow path; disposing a detached element in said chamber for movement thereof between a first position remote from said flow path, and a second position intrusive of said flow path; communicating said inlet with the pump for admitting waste water into said chamber for flow therethrough; and confining means within said chamber, responsive to fluid pressure within said chamber, for moving said element from said first position to said second position.

It is also an object of the invention to set forth a valving device, comprising a housing having a chamber formed therewithin; means for admitting pressured fluid into, and for discharging pressured fluid from, said chamber along a given flow path; detached means within said chamber movable from a first position thereof remote from said flow path, to a second position thereof intrusive of said flow path for preventing fluid flow through said chamber; and means within said chamber, responsive to fluid pressure within said chamber, for moving said detached means from said first position thereof to said second position.

DETAILED DESCRIPTION OF THE PREFERRED EMBODIMENT

Figure 1:
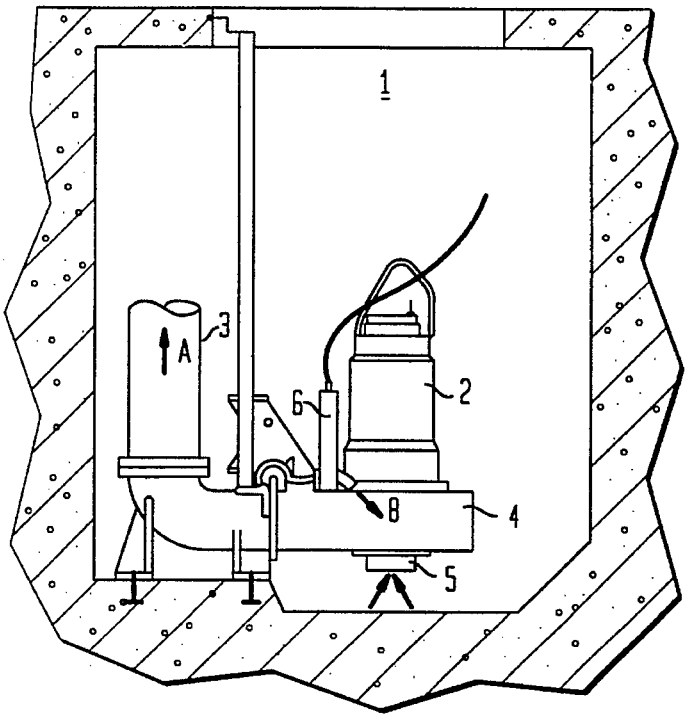
FIG. 1 (PRIOR ART)
FIG. 1 is an illustration of a pump station with a pump unit and an attached, slide-type valve, according to the prior art such as in the cited Swedish Patent Application 7908743-3.

In FIG. 1, a waste water pump station 1 is shown with a submersible pump unit 2 connected to a pressure pipe 3. A pump housing 4 has an inlet 5, and a slide-type valve 6 is coupled to the pump housing 4 for communication thereof with the pump outlet. With pump start-up, the slide-type valve 6 is opened to cause waste water to course therethrough and to discharge via the conduit 8 to cause circulation of the waste water and dispersion of any sludge banks in the station 1. After a given period of time, the valve 6 is closed and, as noted priorly, the valve is cycled through its opening and closing by an electrically-powered linear motor (not shown).

Figure 2:
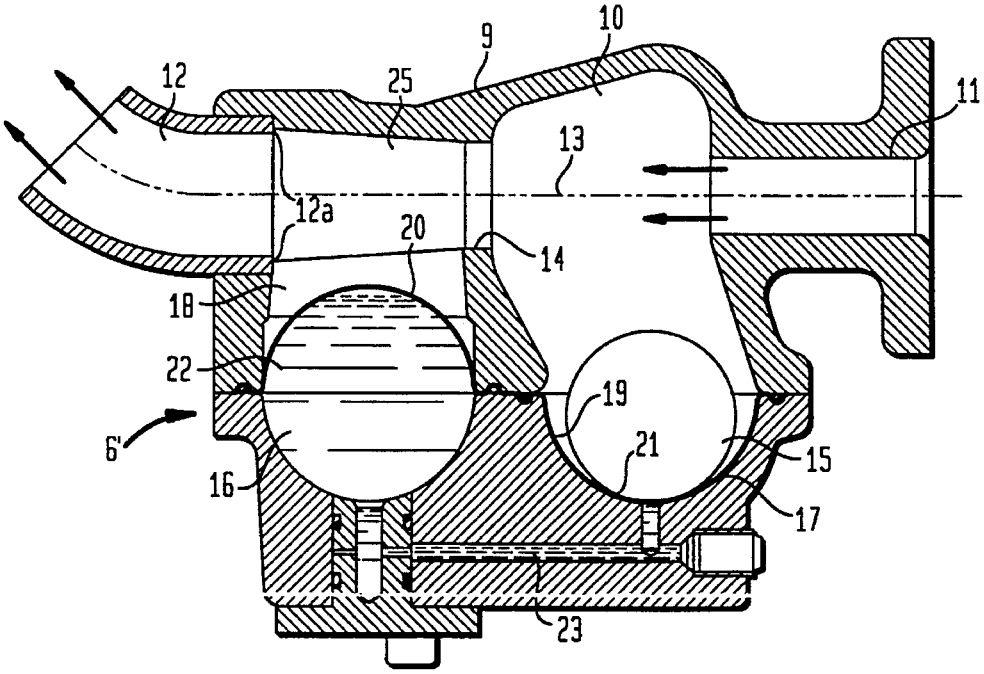
FIG. 2 is an axial cross-sectional view of the novel valve, according to an embodiment thereof, showing the valving ball remote from the flow path.
Figure 3:
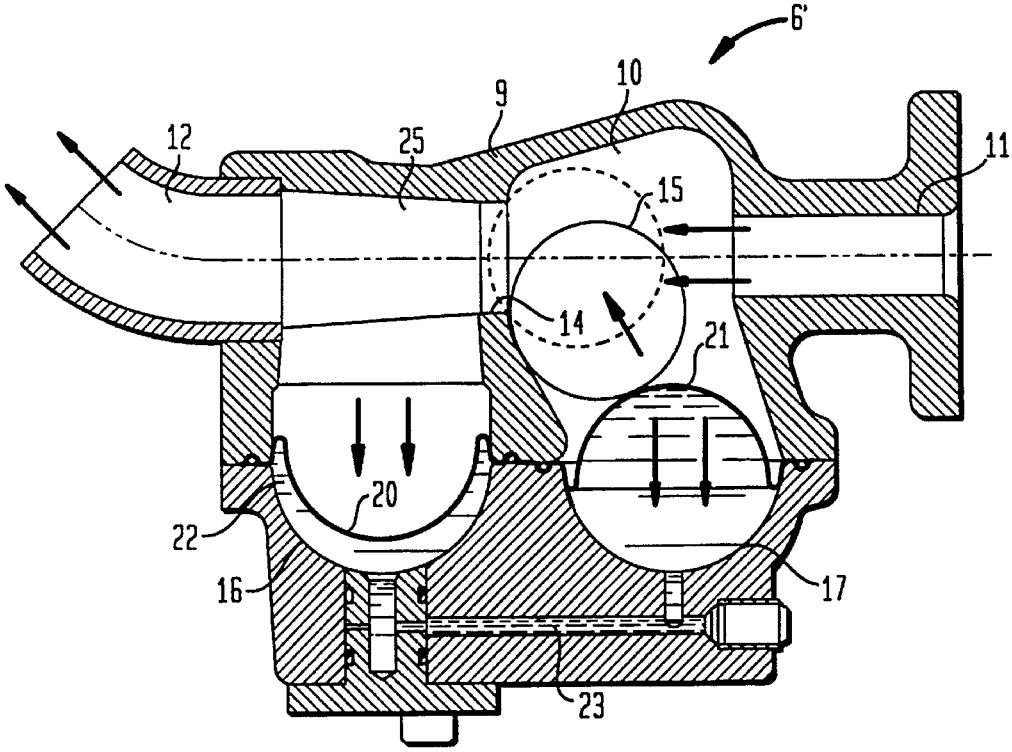
FIG. 3 is a view like that of FIG. 2, showing the valving ball closing onto the valve seat.
Figure 4:
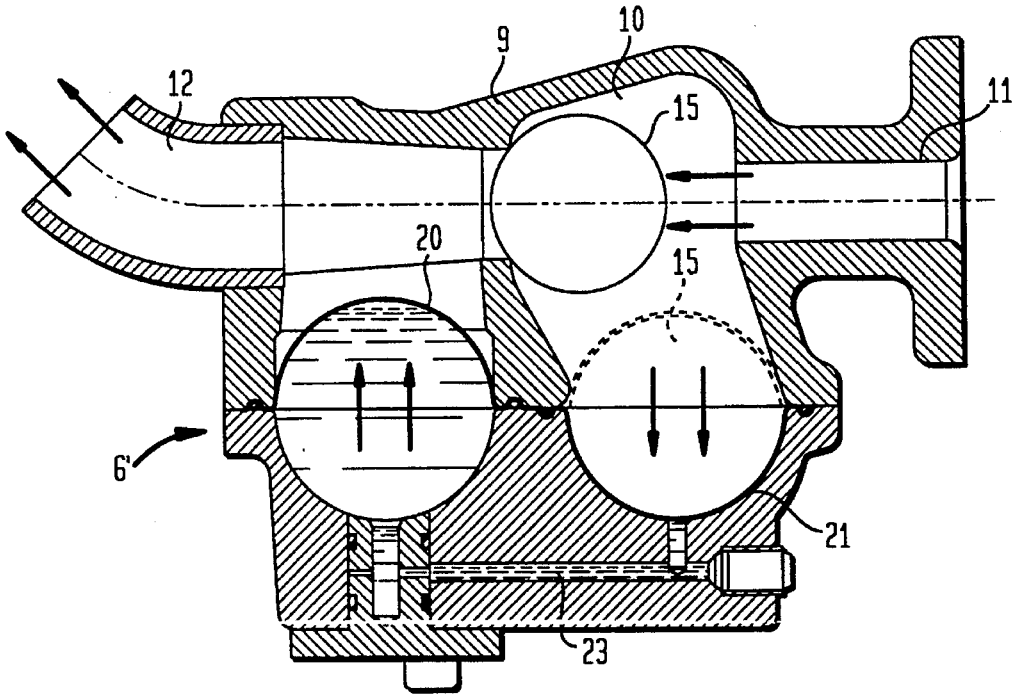
FIG. 4 is a view like that of FIGS. 2 and 3, showing the valving ball in full closure of the valve and set against the valve seat.

According to the instant invention, the valve 6 is supplanted by the novel valve 6' illustrated in FIGS. 2 through 4. Valve 6' has a housing 9 with an inlet chamber 10 formed therewithin, a flanged inlet 11, an outlet chamber 25, and a conduit outlet 12. The inlet 11 and outlet 12 cooperate to accommodate a flow of waste water through the chamber 10 along a flow path 13. By means not shown, but deemed well within the ken of those of ordinary skill in this art, the inlet 11 is put in communication with the outlet of the pump housing (4, FIG. 1) to draw waste water therefrom for the flow thereof through the chamber 10 with pump start-up.

The chamber 10 has a valve seat 14 formed therein and a free ball 15. In addition, the housing has a pair of compartments 16 and 17 formed therein, each thereof having a flexible wall 18 and 19 defined by diaphragms 20 and 21. A hydraulic fluid 22 is confined within the compartments 16 and 17, and a passageway 23 puts the compartments into common fluid communication.

With pump start-up, the valve 6' is in its relaxed state, as shown in FIG. 2. The ball 15 reposes upon a collapsed compartment 17, the ball 25 having come to rest by simple gravity. Too, as it closed upon the diaphragm, its gravity-induced descent caused the fluid 22 to evacuate compartment 17, via the passageway 23, and enter compartment 16. Diaphragm 20 expands to accommodate the fluid 22.

As waste water flows through the chamber 10, along the flow path 13, it creates a under pressure in the inlet chamber 10 an auxiliary pressure in outlet chamber 25. Concomitantly, the discharged waste water agitates the sludge banks in the station (1, FIG. 1), as it courses through the conduit outlet 12. With the under pressure created in the chamber 10 chamber 25 increases further due to the small cross-section as shown, and, the diaphragm 20 proceeds to collapse, as shown in FIG. 3. The pressure differential between chamber 10 and chamber 25 can be further increased by means of the shown shoulder 12*a* and/or the bend in conduit outlet 12. This has the effect of forcing the fluid 22 through the passageway 23 into compartment 17. In turn, then, diaphragm 21 commences to expand and push the ball 15 up toward the valve seat 14. The full expansion of the diaphragm 21 and the capturing flow of waste water via the inlet 11 cooperate to move the ball 15 onto the seat 14 in positive closure of the valve 6', as depicted in FIG. 4. The fluid pressure, then, can only act upon the diaphragm 21 which collapses because of the pressure (and the ball 15), consequently the valve 6' remains closed until the pump stops. Thereafter, the ball 15 descends, again by simple gravity and the valve 6' is ready for another pump start-up. The auxiliary pressure created in chamber 25 is higher than the underpressure created in chamber 10. The design of the chamber 25 makes it possible to utilize the dynamic pressure in the flow and the bend on the outlet 12 causing an obstacle to bring about a pressure increase (auxiliary pressure) in chamber 25 as compared to the pressure (under pressure) in chamber 10.

As will be appreciated, the valve 6' remains open depending upon how long it takes for the hydraulic fluid 22 to evacuate compartment 16 and to fill compartment 17. Self-evidently, the timing can be regulated by using a suitable restrictor in the passageway 23.

The valve 6' operates, automatically, to discharge waste water through the conduit outlet 12, and as disclosed in the foregoing, operates automatically, subsequently, to halt the waste water discharge. Consequently, the discharge operates for a limited period of time, following pump start-up, to effect circulation of the waste water in the station (1, FIG. 1) toward disintegration of the sludge banks therewithin.

For use in a station having a waste water pump, a method for, first, automatically circulating waste water within the station upon pump start-up, and second, automatically halting waste water circulation therewithin, subsequently, comprising the steps of: providing a housing having (a) a chamber formed therewithin, (b) an inlet, and (c) an outlet for conducting waste water through said chamber between said inlet and said outlet along a given flow path; disposing a detached element in said chamber for movement thereof between a first position remote from said flow path, and a second position intrusive of said flow path; communicating said inlet with the pump for admitting waste water into said chamber for flow therethrough; and confining means within said chamber, responsive to fluid pressure within said chamber, for moving said element from said first position to said second position.

While I have described my invention in connection with a specific embodiment thereof, and a novel method of practice, it is to be clearly understood that this is done only by way of example, and not as a limitation to the scope of the invention as set forth in the objects thereof and in the appended claims.

I claim:

1. A valving device, comprising:

a housing having an inlet chamber and an outlet chamber formed therewithin, said inlet chamber being larger than said outlet chamber;

means for admitting a pressured fluid into said inlet chamber, and for discharging said pressured fluid from said outlet chamber along a given flow path;

detached means within said inlet chamber movable from a first position thereof remote from said flow path, to a second position thereof intrusive of said flow path for preventing fluid flow through said inlet chamber and outlet chamber; and means within said inlet chamber and outlet chamber, responsive to differential fluid pressure between said inlet chamber and outlet chamber, for moving said detached means from said first position thereof to said second position, and said detached means, in absence of said pressured fluid, moves from said second position to said first position by gravity.

2. A valving device, according to claim 1, wherein:

said admitting and discharging means comprises a pressured fluid inlet port, fluid coupled to said inlet chamber, and a pressured fluid outlet port, fluid coupled to said outlet chamber;

said inlet chamber has a valve seat formed therein intermediate said inlet and outlet chambers; and said detached means comprises ball means movable onto, and away from, said seat.

3. A valving device, according to claim 1, wherein said fluid pressure responsive means comprises inlet and outlet compartments formed respectively within said inlet and outlet chambers of said housing; and said compartments are formed by and separated from said chambers by diaphragm walls.

4. A valving device, according to claim 3, wherein:

said compartments have a hydraulic fluid medium confined and flowable therewithin.

5. A valving device, according to claim 4, wherein:

said housing has means formed therewithin for effecting hydraulic fluid flow communication between said compartments, said means comprising a passageway opening at opposite ends thereof into said compartments.

* * * * *